United States Patent [19]

Aoki et al.

[11] Patent Number: 4,593,991

[45] Date of Patent: Jun. 10, 1986

[54] COLOR IMAGE FORMING APPARATUS

[75] Inventors: Takao Aoki, Abiko; Keisaku Ushioda, Tokyo, both of Japan

[73] Assignee: Canon Kabushiki Kaisha, Tokyo, Japan

[21] Appl. No.: 738,365

[22] Filed: May 28, 1985

[30] Foreign Application Priority Data

May 30, 1984 [JP] Japan ..... 59-110066

[51] Int. Cl.[4] ..... G03G 15/06

[52] U.S. Cl. ..... 355/14 D; 355/4

[58] Field of Search ..... 355/14 D, 14 R, 3 R, 355/3 DD, 4

[56] References Cited

U.S. PATENT DOCUMENTS 3,987,756 10/1976 Katayama et al. ..... 355/4 X

FOREIGN PATENT DOCUMENTS 1293482 10/1972 United Kingdom ..... 355/4

*Primary Examiner*—R. L. Moses

*Attorney, Agent, or Firm*—Fitzpatrick, Cella, Harper & Scinto

[57] ABSTRACT

A color image forming apparatus wherein a plurality of developing devices are supported on a supporting member which is rotatable to revolve the developing devices to develop the latent images formed on an image bearing member corresponding to color components. When a desired one of the developing devices are to be moved to a developing station, the direction of the revolution is selected depending on the position currently occupied by the desired developing device.

5 Claims, 6 Drawing Figures

COLOR IMAGE FORMING APPARATUS

BACKGROUND OF THE INVENTION

The present invention relates to a color image forming apparatus wherein a plurality of electrostatic latent images formed on an image bearing member through an electrophotographic process or an electrostatic recording process, corresponding to separated color components, and are developed by a plurality of developing devices to provide a color image.

A color image forming apparatus has been put into practice wherein a color-separated image of an original is formed on an electrophotographic photosensitive member as a latent image, which is developed with a developing agent, and the developed image is transferred onto a transfer material, and those operations are repeated with developing agents having different colors, whereby a color image is formed on the transfer material.

This apparatus, however, involves a drawback in that the diameter of the photosensitive member or drum has to be large enough to allow three or for developing devices to be fixedly disposed near and around the photosensitive drum in order to provide a full-color image.

U.S. Pat. No. 3,987,756 has proposed that three or four developing devices for different colors are arranged about an axis so that they are as a whole rotatable about the axis in one direction, whereby a developing device corresponding to a latent image is moved to a developing station when it is to be used. This is advantageous because the diameter of the photosensitive drum may be made smaller. Therefore, the entire image forming apparatus may be made smaller, and in addition, the photosensitive drum may be a multipurpose one (a photosensitive drum is commonly usable for a black-and-white image formation and a multi-color image formation).

However, the mechanism described above is disadvantageous in that it requires at least 1–2 seconds to move, after a developing operation is carried out with a certain color, the next developing device to the developing station. If this time is reduced, the inertia force increases, resulting in a greater shock upon the stoppage of the developing device, which would disturb the image forming process including the latent image forming step even to such an extent that the quality of the image is remarkably degraded. Even if the speed of the movement is maintained, the above-described problems arise if the weight increases. For those reasons, there is a limit in reducing the time required for circulating developing device.

In the color image forming apparatus of this type, when, for example, three copies are taken in a color operation mode wherein only yellow and magenta developing agents are used, the cyan developing device and the black developing device which are not used have to be passed by and stopped at the developing station three times. This leads to slow image formation since the wasteful time is needed. Additionally, the distance through which the developing devices move is larger, resulting in an unnecessary vibration of the apparatus and an unnecessary noise produced.

SUMMARY OF THE INVENTION

Accordingly, it is a principal object of the present invention to provide a color image forming apparatus by which a high speed image formation is possible.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The preferred embodiments of the present invention will be described in conjunction with the accompanying drawings.

Figure 1:
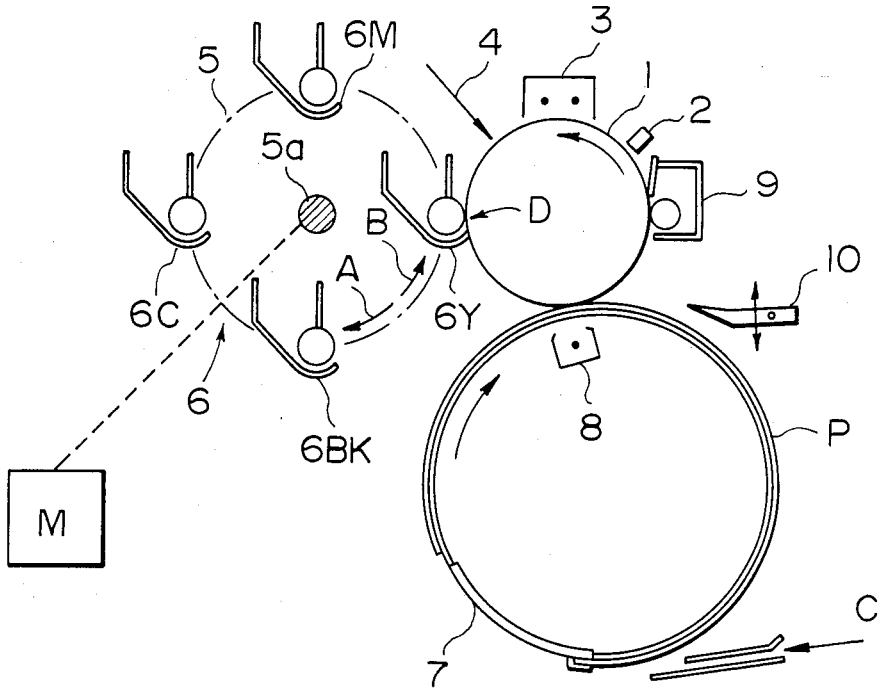
FIG. 1 is a cross-sectional view of a color image forming apparatus with which the present invention is usable.

Referring now to FIG. 1, there is shown a color image forming apparatus with which the present invention is usable. The apparatus shown in FIG. 1 comprises a photosensitive member in the form of a drum 1, which is rotatable in the direction shown by an arrow. The photosensitive drum 1 is firstly exposed to uniform light of a pre-exposure light source, and then uniformly charged by a charger 3. Thereafter, the photosensitive drum 1 is exposed to light 4 of an image corresponding to a color component of an original to be copied, whereby an electrostatic latent image corresponding to the image of the color component is formed on the photosensitive drum 1.

The apparatus further comprises a multicolor developing assembly 6 of a revolvable turret type including developing devices 6Y, 6M, 6C and 6BK with yellow developer, magenta developer, cyan developer and black developer, respectively. Each of the developing devices is supported by two round end plates 5, which are rotatable in two directions shown by arrows A and B about a shaft 5*a* by a motor M. Each of the developing devices 6Y, 6M, 6C and 6BK can be moved to and set at a predetermined developing station D by revolving the developing devices about the shaft 5*a*, so that the latent images of the respective color components are developed with suitable developer agents. The structure for supporting the developing devices may be as shown in Japanese Patent Application Publication No. 20579/1980.

The image developed by the developing device on the photosensitive drum 1 is transferred onto a transfer material P which has been supplied as shown by an arrow C and supported on a surface of a transfer drum 7 having a screen. The developed image is transferred due to the corona discharge electric field provided by a transfer charger 8. The toner not transferred onto the transfer material and remained on the photosensitive drum 1 is removed by a cleaning device 9. In the full-color image forming mode, the developed images of yellow color, magenta color, cyan color and black color are sequentially transferred onto the same transfer material P. Thereafter, the transfer material P is separated from the transfer drum 7 by a separation pawl 10 and transported to an unshown fixing device where the image is fixed, and then it is discharged out of the apparatus. In this manner, a color image is formed.

Figure 2:
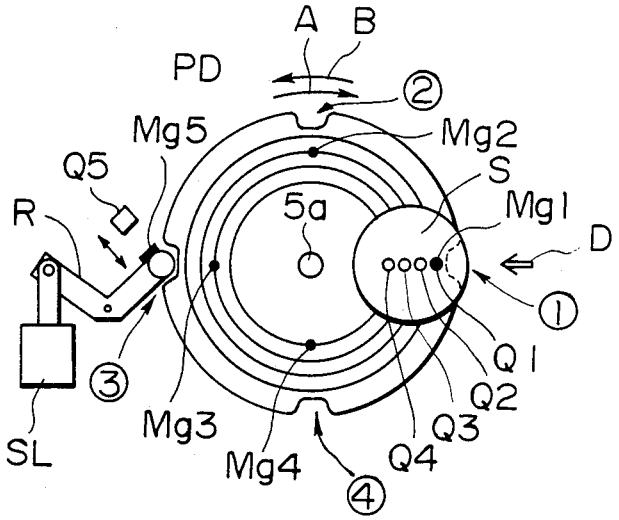
FIG. 2 illustrates a control of the rotation of the developing devices.
Figure 3:
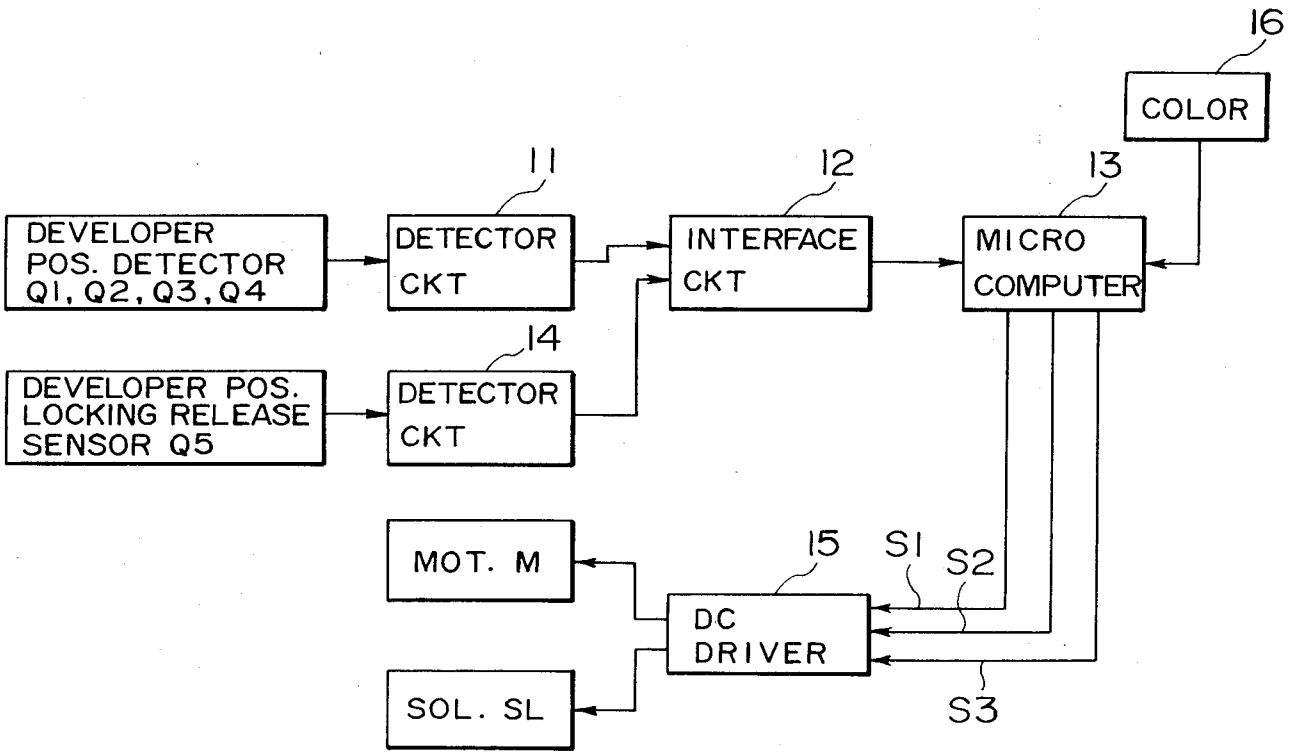
FIG. 3 is a block diagram showing the control of the device shown in FIG. 2.

FIG. 2 illustrates a device for controlling the revolution of the developing devices. FIG. 3 is a block diagram of the control for the FIG. 2 device. In FIG. 2, a position disk PD is fixed to the end plate 5 to which the developing devices 6Y, 6M, 6C and 6BK (FIG. 1) are mounted. The position disk PD is provided with magnets Mg1, Mg2, Mg3 and Mg4 at the positions corresponding to the respective developing devices. In this embodiment, the magnets Mg1, Mg2, Mg3 and Mg4 are disposed at the positions of the developing devices 6Y, 6M, 6C and 6BK, respectively.

At the developing station D, sensors Q1, Q2, Q3 and Q4 each having a Hall IC for detecting the magnets Mg1, Mg2, Mg3 and Mg4, respectively are mounted on a supporting plate S fixed to the main frame of the apparatus.

When the end plates 5 supporting the developing devices rotate, the position disk PD rotates in the clockwise direction (arrow A) or the counter-clockwise direction (arrow B). When the magnet Mg1, Mg2, Mg3 or Mg4 comes to the position of the sensor Q1, Q2, Q3 or Q4, the sensor detects the developing device 6Y, 6M, 6C or 6BK basing upon which sensor detects the magnet. When the sensor Q1, Q2, Q3 or Q4 detects the associated developing device, a detecting circuit 11 produces a developer position detection signal as shown in FIG. 3. The detection signal is read by a microcomputer 13 through an interface circuit 12.

As shown in FIG. 2, a lever R is provided to fix the position of the end plate 5, and therefore, the position of the developing devices. By rendering a solenoid SL coupled to the lever R on and off, the lever R swings in the directions shown by the arrow. When the solenoid SL is rendered off, the free end of the lever R is engaged with a recess formed in the position disk PD so as to fix the end plate 5 and therefore the developing devices. When, on the contrary, the solenoid SL is rendered off, the end of the lever R is disengaged from the position disk PD so as to release the position locking. In the state shown in FIG. 2, the developing device 6Y is fixed at the developing station D by the lever R locked in the corresponding recess. When the lever R is disengaged from the recess, a sensor Q5 having a Hall IC senses the magnet Mg5 mounted adjacent the end of the lever R. When the sensor Q5 detects the release of the lever R, a signal is produced from a detection circuit 14 and transmitted to a microcomputer 13 through an interface circuit 12 so that the release is discriminated.

The motor M is a DC motor which is selectively rotatable in forward and backward directions. The direction of the motor may be selected by the microcomputer 13 transmitting a direction signal S1 to a DC driver 15. More particularly, the motor M rotates in the forward direction, when an opposite rotation gate is rendered off and the motor M is energized. This revolves the developing devices in the direction of the arrow A. The motor M rotates in the backward direction, when the opposite rotation gate is rendered on and the motor M is energized. This revolves the developing devices in the direction of the arrow B. A signal S2 shown in FIG. 3 is a control signal for energizing or de-energizing the motor M, while a signal S3 is a control signal for energizing and de-energizing the solenoid SL. The control device includes a mode selector 16 by which the color image forming modes can be selected among, for example, full-color image, two color image and the like.

Figure 4B:
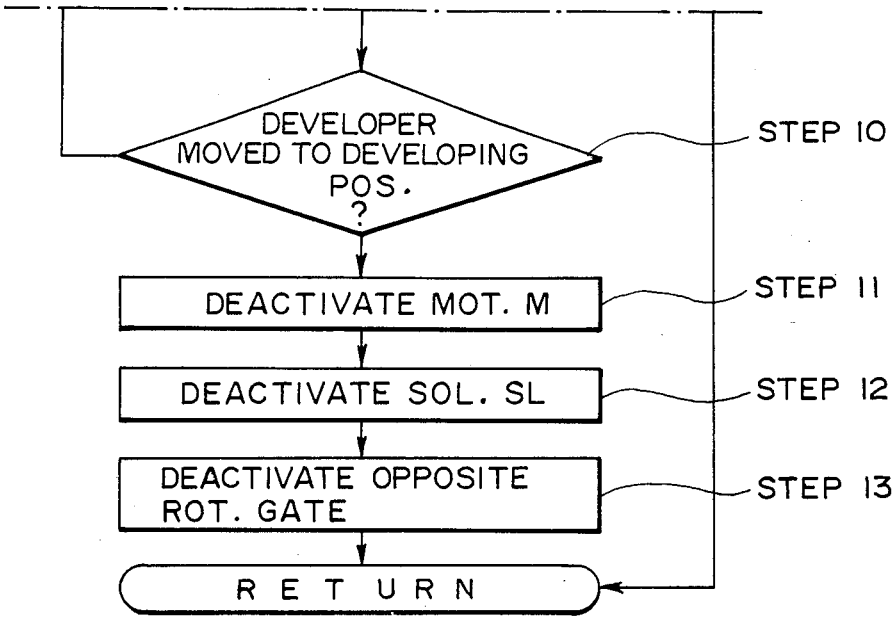
FIGS. 4, 4*a*, and 4*b* comprise a flow chart showing the control of the rotation of the developing devices.
Figure 4:
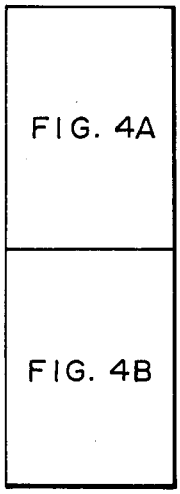

FIG. 4 is a flowchart, with which description will be made as to how to move and stop the developing devices.

It is assumed that the full-color image formation is selected by the mode selector 16, and that the developing operation proceeds in the order of yellow (Y), magenta (M), cyan (C) and black (BK). When the control for the revolution of the developing devices starts, the discrimination is made as to which of the developing devices is at the developing station D basing upon which of the sensors Q1, Q2, Q3 and Q4 detects the associated magnet (step 1). The relative positional relation among the developing devices 6Y, 6M, 6C and 6BK is one of No. 1–No. 4 positions shown in the following Table 1.

TABLE 1

| POSITIONS OF DEVELOPING DEVICES | POSITIONS | | | |
|---|---|---|---|---|
| | ① | ② | ③ | ④ |
| NO. 1 | 6 Y | 6 M | 6 C | 6 BK |
| NO. 2 | 6 M | 6 C | 6 BK | 6 Y |
| NO. 3 | 6 C | 6 BK | 6 Y | 6 M |
| NO. 4 | 6 BK | 6 Y | 6 M | 6 C |

In this Table, the absolute positions are indicated by ① - ④ which is occupied by the magnet Mg1–Mg4 in the disk position shown in FIG. 2. The No. 1–No. 4 positions are stored in a memory not shown.

Further assuming that the developing devices take the No. 1 position, the existence of the developing device 6Y for the yellow color at the developing station D is read at step 1. Then, a position map for the No. 1 position is read out at step 2. At step 3, the required developing device, that is, the yellow developing device 6Y in this example is loaded. At step 4, the discrimination is made as to whether the developing device at the developing station D is the required developing device or not. In this example, the yellow developing device 6Y is already at the developing station D, the result of the discrimination is affirmative. Then, the sequence returns to an unshown control routine for executing the development of the latent image on the photosensitive member 1. Thus, the latent image is developed with yellow toner by the developing device 6Y.

After the developing operation is performed, the magenta toner development is effected. To do this, the operations are the same as described above at steps 1 and 2. At step 3, the magenta developing device is currently loaded, and then the result of discrimination at step 4 is negative. Then, at step 5 the direction of the required revolution is discriminated. Here, the base of the discrimination is whether the required developing device is at the position ④ . More particularly, when the required developing device is at the position ④ , the direction of the revolution is B so as to minimize the distance through which the required developing device moves to the developing station D.

Since the required developing device 6M is at the position ② in this example, the result of discrimination at step 5 is negative. Then, at step 7 the lever R is disengaged from the position disk PD by energizing the solenoid SL so as to release the position disk PD from the lever R.

At step 8, the release of the position disk PD from the lever R is confirmed, and then, at step 9 the motor M is actuated to revolve the developing device. Since the opposite rotation gate of the motor M is off, the motor M rotates in the forward direction so as to revolve the developing devices in the direction of the arrow A.

When the developing device 6M starts moving from the position 2 in the direction of the arrow A, the discrimination is made at step 10 as to whether or not the developing device 6M reaches the developing station D. When the result of discrimination becomes affirmative, the motor M is de-activated at step 11. Thereafter, at step 12 the solenoid SL is de-energized to engage the free end of the lever R with the recess of the position disk PD which is indicated by ④ in FIG. 2 so that the developing device 6M is fixed at the developing station D.

A step 13 is to render the opposite rotation gate of the motor M off. However, in this example the opposite rotation gate is off so that the sequence goes to the unshown development control routine without any change of state at the step 13. Thus, the latent image is developed with magenta toner by the developing device 6M.

In the like manner, after the development with the magenta toner, the developing operations follow with the cyan toner and then the black toner. That is, similarly to the change from the yellow toner development to the magenta toner development, the developing device 6C and then the developing device 6BK revolve in the direction of the arrow A to perform the developing operation with the cyan toner and black toner. Thus, four-color development is accomplished. The routine of the revolution control ends with the opposite rotation gate rendered off.

Description will now be made with respect to two color (yellow and black) development mode selected by the mode selector 16.

Assuming that the developing devices take the No. 1 position of Table 1, the first developing operation with the yellow toner is executed in the same manner as described with respect to the full-color development.

Then, the second color, that is, black toner development is performed. At step 4 in FIG. 4, the developing device 6BK is not at the developing station D so that the result of the discrimination is negative. At step 5, the direction of the revolution is discriminated. As will be understood from Table 1, the developing device 6BK is at the position ④ , the direction of revolution is the opposite, that is, the direction B. Therefore, the result of discrimination at step 5 is affirmative. At step 6, the opposite rotation gate of the motor M is rendered on, and at step 7 the solenoid SL is energized so that the lever R takes its releasing position. Then, at step 9 the motor M is actuated and rotates in the opposite direction to revolve the developing device 6BK in the direction of the arrow B. Thereafter, the developing device 6BK is fixed at the developing station D through the steps 10–12. The opposite rotation gate of the motor M is reset to "off" state at step 13. The sequence then returns to the unshown development control routine. Thus, the revolution control routine ends, and the latent image is developed with the black toner by the developing device 6BK.

As described above, the developing devices are revolvable in the opposite directions A and B, and the direction can be selected on the basis of the current position of the required developing device with respect to the developing station, whereby the distance through which the developing device is moved to the developing station. For example, in the case where the black toner development is to be performed after the yellow toner development is executed as described above, the developing device 6BK has to be set at the developing station D after the developing devices 6M and 6C pass by the developing station D, if the direction of the revolution is fixed in only one direction, e.g., A. This wastefully spends the time. However, according to the embodiment of the present invention, the developing devices are revolvable in the opposite direction B, so that the required developing device 6BK can be quickly set at the developing station D by the minimum distance of movement.

In the foregoing description of the embodiment, the developing device 6Y is set at the developing station D at the initial state, and the developing device 6BK is moved to the developing station. When the developing device 6M is moved to the developing station D from the state wherein the developing device 6Y is at the developing station D, the developing device 6M is revolved in the direction A with the minimum distance of movement.

In the case where the positional relationship among the developing devices is as shown in Table 1 as No. 2, No. 3 or No. 4, the direction of revolution is forward, i.e. direction A when the developing device located at the position ② is moved to the developing station D from the state wherein the developing device 6M, 6C or 6BK is at the developing station. When the developing device located at the position ④ is to be moved to the developing station D, the direction of the revolution of the developing device is the opposite, that is, direction B. Thus, each of the developing devices can be moved to the developing station D with the minimum distance of movement.

As described above, according to the embodiment of the present invention, the distance through which the developing device is moved is minimized in accordance with the mode of color image formation (for example, two color image formation or three color image formation). Further, when the adjacent ones of the developing devices are alternately and repeatedly operated to form the image, the overall speed of image formation is increased. Also, since only the required developing devices are selected and used, the amount of developing device movement is minimized with the result that the time required for movement is reduced and that the vibration or noise can be minimized.

The present invention is advantageous when a developing device used with red toner is additionally provided adjacent the black color developing device 6BK in the apparatus shown in FIG. 1 which is for forming a color image with the basic four color developers, whereby the image is formed with red toner and black toner.

Further, the present invention is advantageous when a multi-color image formation is performed in the color image forming apparatus having the developing devices for more than four colors, e.g., green, blue or other color toner.

In the present invention, the revolution of the developing devices is not limited to circular movement but may be along an oval path of movement.

While the invention has been described with reference to the structures disclosed herein, it is not confined to the details set forth and this application is intended to cover such modifications or changes as may come within the purposes of the improvements or the scope of the following claims.

What is claimed is:

1. A color image forming apparatus wherein electrostatic latent images corresponding to color components are formed on an image bearing member and developed to provide a color image, comprising:

a plurality of developing units each having a developing agent of a predetermined color;

means for revolvably supporting said plurality of the developing units;

driving means for driving said supporting means to move a desired one of said developing units to a developing station, said driving means being capable of revolving said supporting means in first and second directions wherein the second direction is opposite to the first direction; and control means for selecting the direction of revolution of said supporting means when the desired one of said developing units is to be moved to the developing station.

2. An apparatus according to claim 1, wherein said control means selects the direction of revolution so as to minimize the distance through which the desired one of said developing units is moved.

3. An apparatus according to claim 1 or 2, wherein said control means includes means for detecting a developing unit located at the developing station, means for producing a signal for instructing the direction of rotation of said supporting means in accordance with the detection signal of said detecting means and with which one of said developing units is desired, and means for locking the desired developing unit at the developing station.

4. An apparatus according to claim 1, wherein said control means is controlled in accordance with a color image mode which is selectable.

5. An apparatus according to claim 4, wherein said driving means revolves said supporting means in one direction when a full-color image is to be formed.

* * * * *

UNITED STATES PATENT AND TRADEMARK OFFICE

CERTIFICATE OF CORRECTION

PATENT NO. : 4,593,991

DATED : June 10, 1986

INVENTOR(S) : TAKAO AOKI, ET AL.

Figure 4A:
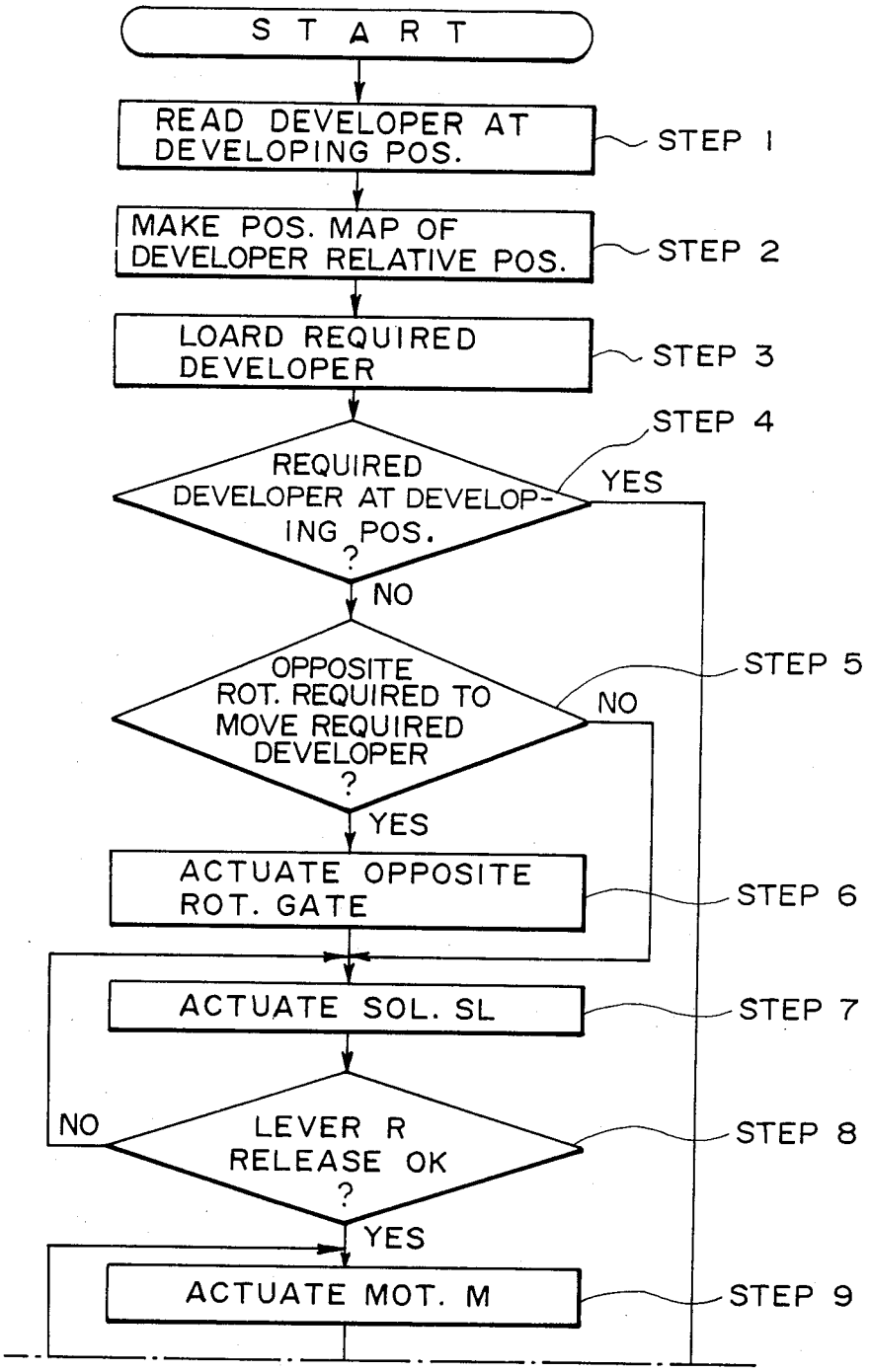

It is certified that error appears in the above-identified patent and that said Letters Patent is hereby corrected as shown below:

IN THE DRAWINGS:

Sheet 5, Fig. 4A, in STEP 3, "LOARD" should read --LOAD--.

Col. 1, line 25, change "for" to --four--.

Col. 2, line 64, "remained" should read --remaining--.

Col. 3, line 28, "basing" should read --based--.

Col. 3, line 39, "off" should read --on--.

Col. 3, line 59, "direction, when" should read --direction when--.

Col. 4, line 14, "basing" should read --based--.

Col. 4, line 58, "base" should read --basis--.

Signed and Sealed this

Third Day of March, 1987

*Attest:*

*Attesting Officer*

DONALD J. QUIGG

*Commissioner of Patents and Trademarks*